United States Patent [19]

Aeschliman

[11] Patent Number: 4,613,042

[45] Date of Patent: Sep. 23, 1986

[54] LAMP HOLDER

[75] Inventor: Walter H. Aeschliman, Bluffton, Ind.

[73] Assignee: Kar-Glo Industries, Inc., Bluffton, Ind.

[21] Appl. No.: 727,281

[22] Filed: Apr. 25, 1985

[51] Int. Cl.[4] ..... B65D 85/42

[52] U.S. Cl. ..... 206/419; 206/372; 206/443

[58] Field of Search ..... 206/419, 379, 443, 372, 206/373; 248/210

[56] References Cited

U.S. PATENT DOCUMENTS

| | | | |
|---|---|---|---|
| 2,584,721 | 2/1952 | Linneman | 206/379 |
| 2,647,712 | 8/1953 | Sandmoen . | |
| 2,898,069 | 8/1959 | Kramer . | |
| 3,179,255 | 4/1965 | De'Caccia . | |
| 3,273,846 | 9/1966 | De Mare . | |
| 3,910,541 | 10/1975 | German . | |
| 3,987,993 | 10/1976 | Hopkins . | |
| 4,253,830 | 3/1981 | Kazen et al. | 206/379 |
| 4,431,038 | 2/1984 | Rome . | |
| 4,482,049 | 11/1984 | Kot, II | 206/443 |

FOREIGN PATENT DOCUMENTS

| | | | |
|---|---|---|---|
| 695174 | 9/1964 | Canada | 206/379 |
| 2321322 | 11/1974 | Fed. Rep. of Germany | 206/379 |

*Primary Examiner*—Joseph Man-Fu Moy

*Attorney, Agent, or Firm*—Jeffers, Irish & Hoffman

[57] ABSTRACT

A lamp holder for attachment to a stepladder comprising a plurality of tapered tubes of different lengths integrally joined at their top ends so that a plurality of lamps can be held by the tubes at selected heights. A clamp is connected at one end thereof to the joined tubes and is detachably connected at the other end thereof to the stepladder at a preselected orientation so that the tubes are generally vertically disposed.

5 Claims, 7 Drawing Figures

FIG. 1
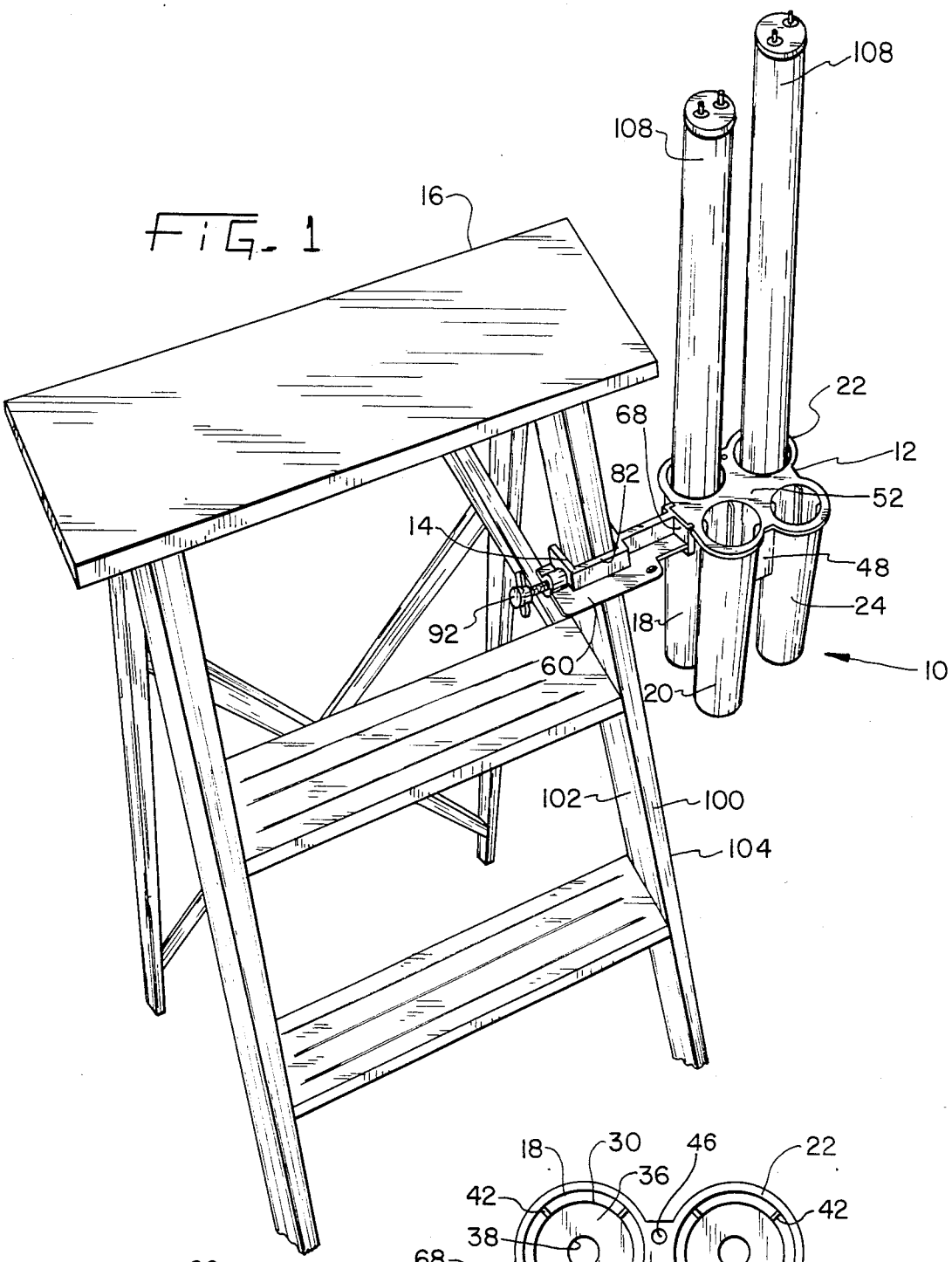
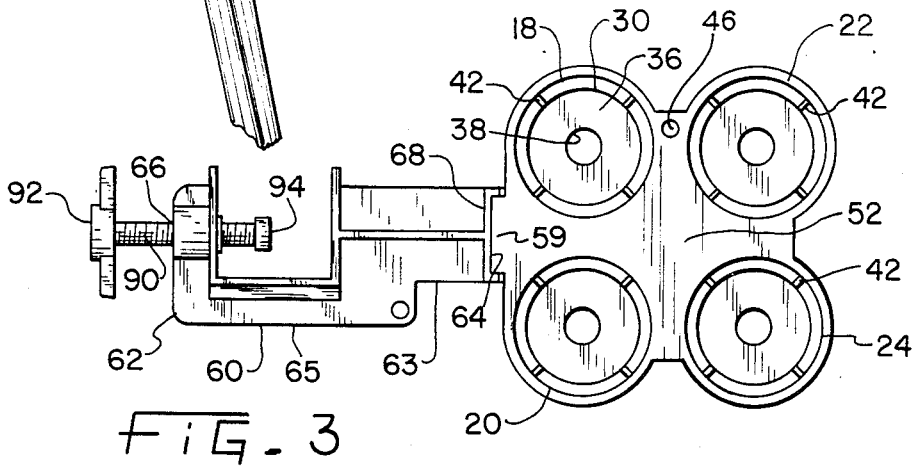
FIG. 3

LAMP HOLDER

BACKGROUND OF THE INVENTION

The invention relates to a lamp holder, and more particularly, to a lamp holder that is detachably mounted to a support structure, such a stepladder, and is capable of holding one or more lamps, such as fluorescent lamps, in a generally vertically disposed orientation.

In the past, two basic approaches have been utilized to change ceiling fluorescent lamps or ballasts both of which have meaningful drawbacks. One approach requires two persons to change fluorescent lamps or ballast wherein one person stands on a stepladder and connects or disconnects the fluorescent lamps or ballast, and a second person stands on the ground so as to receive the old fluorescent lamps or ballast and hand new fluorescent lamps to the person on the stepladder. As can be appreciated, the use of two people to change fluorescent light lamps or ballast has a major drawback in that such a two-person operation is very labor intensive. Another drawback is that there exists the chance during the handling of the fluorescent lamps between the two persons that the lamps may either be dropped and broken or hit against the side of the stepladder and broken.

Another basic approach to changing fluorescent lamps or ballast requires only one operator, however, since the new lamps, and ballast, as well as the old lamps, must be placed on the ground next to the stepladder, the person changing the fluorescent lamps or ballast must make numerous trips up and down the stepladder. Such a process is both tiresome to the person changing the fluorescent lamps or ballast as well as very time consuming. Although only one person is used to make the changes, in view of the numerous trips up and down the stepladder that are required, such a process is again very labor intensive and this constitutes a major drawback. Further, operator fatigue as well as a possibility of breakage due to either dropping the fluorescent lamp or hitting it against the stepladder during the numerous trips up and down the stepladder constitute meaningful drawbacks.

It is thus apparent that it would be very desirable to provide a device for use in the changing of a lamp, such as a fluorescent lamp and especially a fluorescent lamp in a ceiling, that provides labor savings by requiring only one person to change the lamps or ballast and by not requiring this person to make numerous trips up and down the stepladder during the changing operation. It would also be desirable to provide such a device that provides increased safety during the changing operation in that the opportunity is reduced for lamps to be either dropped or hit against the stepladder by providing easy access to the lamps for the person while standing on the stepladder and by providing adequate support for new lamps to be installed in the fixture or old lamps removed from the fixture.

SUMMARY OF THE INVENTION

The present invention is directed to a lamp holder that overcomes the above described disadvantages associated with the present approaches to changing lamps, such as overhead fluorescent lamps, and changing ballasts. By the invention, one is able to reduce labor costs associated with changing overhead fluorescent lamps and ballasts in that only one operator is required. Further, the invention reduces the amount of time spent by one operator in the changing operation in that only one trip up and down the stepladder is required. Finally, there is provided a lamp holder which reduces the opportunity for breakage of the fluorescent lamp either due to dropping or hitting the lamp against the stepladder since multiple trips up and down the stepladder and the handling of lamps between two operators are eliminated. The lamp holder provides easy access thereto to either remove new lamps for installation or deposit old lamps after removal, and securely positions the lamps within the lamp holder.

In one form thereof, the invention constitutes a lamp holder for attachment to a support structure comprising a holder means for holding a plurality of lamps wherein each lamp is held at a selected height, and a clamp means for rigidly connecting the holder means at a selected orientation to the support structure.

In another form thereof, the invention is a lamp holder for attachment to a support structure comprising a plurality of tapered tubes each having an open top end and a closed bottom end. The tubes are joined at the top ends thereof. A resilient member is contained within each tube adjacent the bottom end thereof.

Each tube includes an interior surface having a plurality of ribs extending therefrom in a radially inward fashion. The radially extending edge of each rib is fashioned to contact a lamp received within the tube so as to maintain the lamp in a spaced-apart fashion from the interior surface of the tube.

A clamp has an elongate body with opposite ends wherein at one end of the body there is an attachment bracket containing generally vertically disposed channels that receive runners so as to connect the joined tubes to the clamp. The elongate clamp body at the other end thereof has a mounting bracket assembly which includes a mounting bracket and a thumb screw wherein the mounting bracket is disposed at an angle to the channels. The angle at which the mounting bracket is disposed to the channels generally corresponds to the angle at which the portion of the support structure to which the mounting bracket assembly is attached is disposed from a vertical axis so that the tubes remain generally vertically disposed.

It is therefore an object of the invention to provide an improved lamp holder for attachment to a support structure.

It is another object of the invention to provide an improved lamp holder for attachment to a support structure wherein only one operator is required to change overhead fluorescent lamps or ballasts.

It is another object of the invention to provide an improved lamp holder for attachment to the support structure wherein a single operator is required to make only one trip up and down a stepladder to change a plurality of overhead fluorescent lamps or to change ballasts.

Finally, it is an object of the invention to provide an improved lamp holder for attachment to a support structure wherein the opportunity is reduced for breakage of the fluorescent lamps by securely holding lamps in a generally vertical position in the lamp holder, and by providing the operator on the stepladder easy access to lamps held on the lamp holder.

DETAILED DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings.

FIG. 1 is a perspective view of a specific embodiment of the lamp holder of the invention attached to a stepladder;

FIG. 3 is a top plan view of the lamp holder of FIG. 1 not having any fluorescent lamps held thereby;

DETAILED DESCRIPTION OF A SPECIFIC EMBODIMENT

Figure 4:
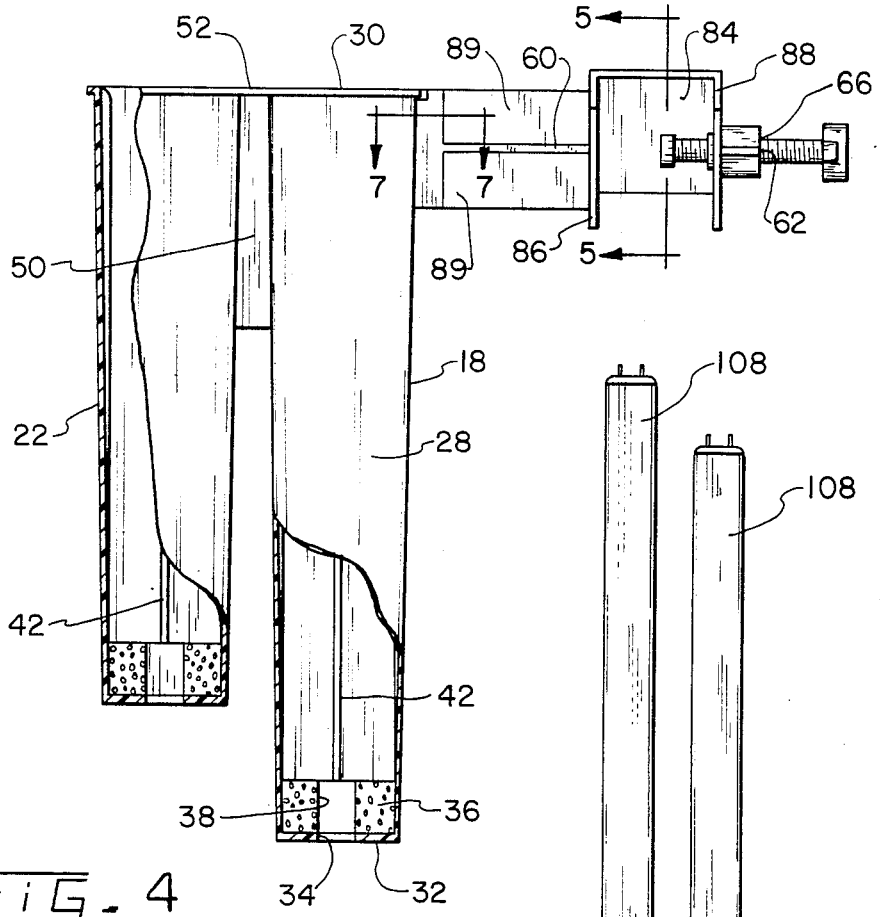
FIG. 4 is a side elevation of the lamp holder of FIG. 1 having a portion thereof cut away.

Referring to the drawings, there is illustrated in FIG. 1 a specific embodiment of the lamp holder of the invention generally designated as 10. Lamp holder 10 includes a holder portion 12 and a clamp portion 14. The holder portion and the clamp portion are detachably connected as will be discussed in more detail hereinafter. FIG. 1 further illustrates a support structure, and more particularly a stepladder 16, to which the lamp holder 10 is detachably mounted.

Holder portion 12 includes a pair of substantially identical long tapered tubes 18 and 20 and a pair of substantially identical short tapered tubes 22 and 24. The construction of the long tubes 18 and 20 is essentially the same as that for the short tubes 22 and 24 except for the length. Consequently, a description of long tapered tube 18 will suffice for a description of the other three tapered tubes 20, 22 and 24. It should be understood that the present invention does not contemplate any specific number of tapered tubes, and that the presence of four tapered tubes in the specific embodiment should not be considered as limiting the scope of the invention.

Tapered tube 18 includes a tapered cylindrical tube body 28 having an open top end 30 and a closed bottom end 32 containing a hole 34 therein. A cylindrical resilient cushion 36 is mounted within tube 18 on bottom end 32. Cylindrical cushion 36 contains a hole 38 which is coaxial to hole 34 contained in bottom end 32. Cylindrical cushion 36 is made from a sponge rubber or other material of like resiliency so as to cushion a fluorescent lamp 108 contained within the tube 18. Tapered cylindrical tube 28 further includes an interior surface 40 from which four longitudinal ribs 42 extend in a radially inward fashion. Each longitudinal rib includes a rounded top shoulder 44 which terminates adjacent the top end 30 of tapered tube 28. The rounded shoulders seem to assist in guiding lamps 108 as they are inserted.

Tapered tubes 18, 20, 22 and 24 are joined at their exterior surfaces adjacent from the top ends thereof by a plurality of ribs. With respect to the ribs that are illustrated, rib 48 joins tapered tubes 20 and 24, rib 50 joins tapered tubes 18 and 22, and rib 51 joins tapered tubes 18 and 20. There is also a rib which joins tapered tubes 22 and 24; however, that is not illustrated in the drawings. The tapered tubes 18, 20, 22 and 24 are joined at their top ends by a generally planar top member 52. Tapered tubes 18 and 20 are further joined by a generally vertically disposed planar member 54 which extends downwardly from top planar member 52. A pair of L-shaped members or runners 56 and 58 extend outwardly from the surface of generally vertically disposed planar member 54. An abutment 59 is located at and extends between the top portions of L-shaped members 56 and 58. Top planar member 52 contains a hanging hole 46 therein to enable holder portion 12 to be hung up for storage.

Clamp portion 14 includes a generally horizonally disposed planar body 60 having opposite ends 62 and 64. Planar body further includes a narrow width portion 63 adjacent one end 64 thereof, and a wider width portion 65 adjacent the other end 62 thereof. An enlarged threaded bore 66 is contained adjacent end 62 of planar body 60. A mating portion 68 is at the other end 64 of planar body 60. Mating portion 68 includes a C-shaped member 70 having a rear wall 72, integral side walls 74 and 76 disposed perpendicularly with respect to rear wall 72, and a pair of integral front walls 78 and 80 disposed so as to be generally perpendicular with respect to side walls 74 and 76. C-shaped member 70 defines a pair of channels 81 and 83.

Planar body 60 further includes a generally vertically disposed U-shaped holder 82 having a rear wall 84 and side walls 86 and 88. A generally vertically disposed flange 89 projects from the top and bottom surface of planar body 60 and extends between side wall 86 of U-shaped holder 82 and rear wall 72 of C-shaped member 70. A thumb screw assembly is threadably received in threaded bore 66 and includes a threaded shaft 90 having a handle 92 at one end thereof and a foot 94 at the other end thereof. Planar body 60 further contains a hanging hole 96 therein.

Lamp holder 10 is a device which provides for the efficient changing of overhead fluorescent lamps, ballasts or the like by a single operator. As illustrated in FIG. 1, the clamp portion 14 is detachably mounted to the leg of the stepladder. The point along the stepladder leg at which the lamp holder is mounted can be selected to conform with the particular mounting application.

The clamp portion 14 is mounted so that the front surface 100 of the stepladder leg contacts rear wall 84 of U-shaped holder 82, the interior surface 102 of the stepladder leg is contacted by the foot 94 of the thumb screw assembly, and the exterior surface 104 of the stepladder leg contacts side wall 86 of U-shaped holder 82. As can be appreciated, the thumb screw assembly provides the clamping portion with the ability to be securely detachably mounted to a support structure, such as a stepladder leg, of varying widths.

Figure 6:
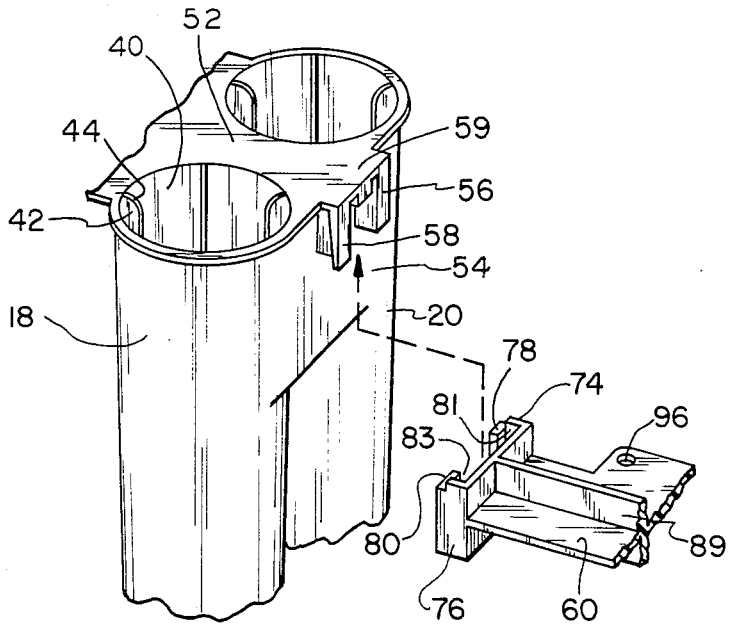
FIG. 6 is a fragmentary perspective view illustrating the connection between the holding portion and clamping portion of the lamp holder of FIG. 1.
Figure 7:
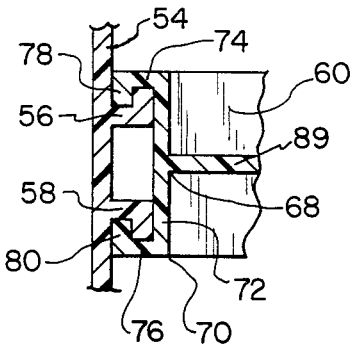
FIG. 7 is a cross-sectional view illustrating the connection between the holding portion and clamping portion taken along section line 7—7 of FIG. 4 and viewed in the direction of the arrows.

The holder portion 12 is detachably connected to the clamp portion 14 as more specifically illustrated in FIGS. 6 and 7. As can be seen, the L-shaped members 56 and 58 are received within channels 81 and 83 so that the holder portion 12 and clamp portion 14 are securely connected together. More specifically, the holder portion 12 is positioned so that the L-shaped members 56 and 58 are received through the top end of channels 81 and 83, respectively, and then the holder portion 12 is moved downwardly relative to the clamp portion 14 until the top edge surface of C-shaped member 70 is generally co-planar with the surface of top planar member 52 and abutment 59. There is thus provided a firm detachable connection between the holder portion and the clamp portion.

Figure 5:
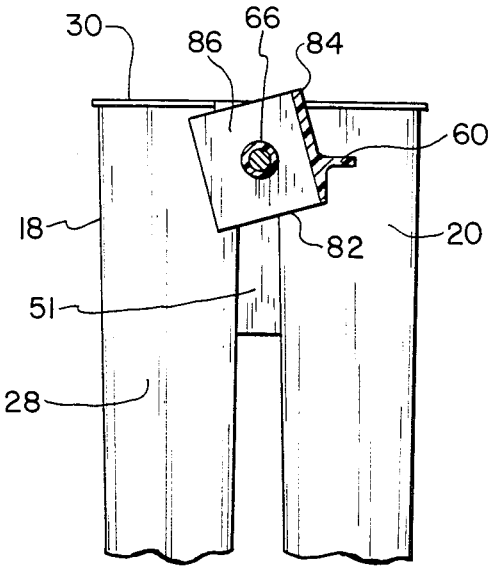
FIG. 5 is a fragmentary cross-sectional view of the lamp holder taken along section line 5—5 of FIG. 4 and viewed in the direction of the arrows.

Both the L-shaped members 56 and 58 and the C-shaped member 70 are generally vertically disposed as are the tubes 18, 20, 22 and 24. It will therefore be appreciated that the general alignment of the tubes will be the same as the alignment of the L-shaped members and the C-shaped member which together mount the clamp portion and the holder portion together. As can be seen from the illustration of the stepladder in FIG. 1, the stepladder leg to which the lamp holder 10 is affixed is not generally vertically disposed, but is disposed at an angle with respect to a vertical axis. In order that the clamp portion can be firmly mounted to the stepladder leg wherein the front and side surfaces of the stepladder leg are in contact with the rear wall, side wall 86, and foot 94, the U-shaped holder 82 is tilted or oriented so that the plane of the rear wall 84 is disposed at an acute angle with respect to a vertical plane. This feature is illustrated very clearly in FIG. 5. By orienting U-shaped holder 82 in this fashion, the clamp portion is securely mounted to the stepladder leg, which is not vertically disposed, with the entire rear wall 84 supported on the ladder, and the tapered tubes which hold the fluorescent lamps still generally vertically disposed. As can be appreciated, by maintaining the general vertical disposition of the tapered tubes, the fluorescent lamps received within the tapered tubes are generally vertically disposed in a stable fashion.

Figure 2:
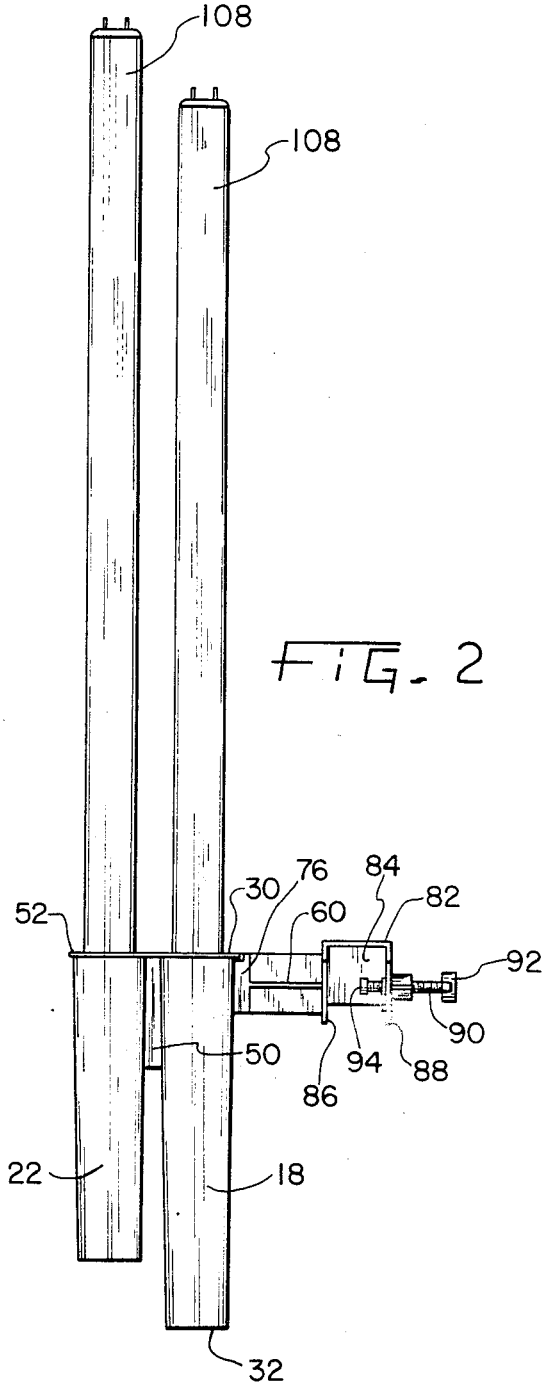
FIG. 2 is a side elevation of the lamp holder illustrated in FIG. 1 having two fluorescent lamps held thereby.

FIGS. 1 and 2 illustrate a pair of fluorescent lamps of the same length and diameter that are received within tapered tubes 18 and 22. As can be appreciated, each tube is tapered such that at some point during the insertion of a fluorescent lamp therein the surface of the lamp is engaged by the radially projecting ribs, and the lamp is securely held within the tapered tube. The height at which the fluorescent lamps are supported varies between the long tube 18 and the short tube 22 so that there is a staggered orientation of the top ends of the fluorescent lamps of equal length and diameter. In other words, the generally horizontal planes in which the top ends of the fluorescent lamps lie vary between fluorescent lamps held in the short tubes or the long tubes. By providing this so-called staggered orientation, it is easier for the operator standing on the stepladder to retrieve a selected fluorescent lamp since the operator can reach and directly grasp the top end of the selected fluorescent lamp without having to reach around an adjacent fluorescent lamp. This would not be the case if the top ends of all of the fluorescent lamps were to lie in the same generally horizontal plane since the operator would have to reach around some lamps to get to other lamps. Rather than providing tubes of different lengths, tubes of identical lengths but staggered vertically could be used. Cylindrical cushion 36 contained at the bottom end of the tapered tubes provides for a cushioning effect for the fluorescent lamps received within the tubes so as to reduce the possiblity of their breakage.

The lamp holder can be used to handle lamps of almost any length and lamps of any diameter that will allow the lamp to rest on cushion 36 within the tapered tube. It can thus be seen that the lamp holder has application to a wide variety of lamps.

As can be appreciated, by using the lamp holder of the invention only one operator is required to change overhead fluorescent lamps or ballasts. In the changing operation, the operator first connects the lamp holder, by means of the clamp portion, to a stepladder at the desired position whether at the front, rear or to the sides of the stepladder. The new fluorescent lamps are then be inserted into their respective tapered tubes. The operator then climbs up the stepladder and assumes a position required for the changing operation. Once the operator deteches a discarded fluorescent lamp, a new fluorescent lamp can be removed from the lamp holder and the old discarded fluorescent lamp inserted into the empty tube. The operator can then insert the new fluorescent lamp in the light fixture. This operation can be repeated until all the fluorescent lamps are replaced or the lamp holder runs out of new fluorescent lamps. Once the changing operation has been completed, the operator can then climb down the stepladder and once standing on the ground can then retrieve the old spent fluorescent lamps from the lamp holder and discard them. The holder portion can be detached from the clamp portion leaving it attached to the stepladder, and used to carry the old lamps to be discarded and/or carry new lamps back to the stepladder.

A further advantage to the staggered arrangement of the tubes is that the operator can easily view the bulbs to distinguish between old and new lamps.

By not having to hand fluorescent lamps to one another, as would be the case in a two person overhead fluorescent lamp changing operation, or climb up and down the stepladder numerous times with the fluorescent lamps in hand, as would be the case in a one person overhead fluorescent lamp changing operation, the possibility of breakage of the fluorescent lamps is reduced. As can be appreciated, advantages provided by the lamp holder for a lamp changing operation are also provided for a ballast changing operation.

It should also be mentioned that U-shaped lamps can be accommodated by the lamp holder of the invention wherein the opposite ends of the U-shaped lamp are contained in corresponding tapered tubes. The advantages provided for a U-shaped fluorescent lamp as compared to those for a straight fluorescent lamp would be substantially the same in that there is a reduction of labor required, a reduction of time required to change the lamps and a reduction of possibility of breakage of the fluorescent lamp.

While there have been described above the principles of this invention in connection with specific apparatus, it is to be clearly understood that this description is made only by way of example and not as a limitation to the scope of the invention.

What is claimed is:

1. A fluorescent lamp holder comprising:

a first rigid tubular compartment and a second rigid tubular compartment, said tubular compartments having open top ends and closed off bottom ends and having sufficient length and width to support therein upon said closed off bottom ends of elongate fluorescent lamps, said tubular compartments being connected together substantially parallel to one another with the bottom ends being vertically offset so that upper ends of lamps of the same length received in the compartments will be vertically offset thereby enabling easy grasping and viewing of the upper ends of the lamps, and a plurality of longitudinal reinforcing ribs on a side wall of each of said tubular compartments, a resilient cushion within each of said tubular compartments located on the bottom ends thereof adapted for cushioning the ends of lamps supported in the compartments to prevent breakage and damage to the contact pins of the lamps when the lamps are inserted; and clamp means detachably connected to said tubular compartments for rigidly clamping said tubular compartments to a support structure and for supporting said compartments in a substantially vertical position wherein said tubular compartments are connected to said clamp means by a cantilever support element having a reinforcing flange thereon.

2. The lamp holder of claim 1 further comprising third and fourth tubular compartments connected to said first and second compartments, said third and fourth compartments having bottom ends being vertically offset so that upper ends of lamps of the same length received in the third and fourth compartments will be vertically offset thereby enabling easy grasping and viewing of the upper ends of the lamps, and a resilient cushion within each of said third and fourth compartments located on the bottom ends thereof.

3. A fluorescent lamp holder comprising:

a first rigid tube and a second rigid tube, said tubes having open top ends and closed off bottom ends and having sufficient length and width to support therein upon said closed off bottom ends elongate fluorescent lamps, said tubes being connected together substantially parallel to one another with said open top ends in substantially the same plane, said second tube being longer in length than said first tube;

a third tube substantially identical to said first tube and a fourth tube substantially identical to said second tube, said third and fourth tubes connected to said first and second tubes substantially parallel thereto with the top ends thereof substantially in the same plane as the ends of said first and second tubes;

a resilient cushion within each of said tubes located on the bottom ends thereof adapted for cushioning the ends of lamps supported in the compartments to prevent breakage and damage to the contact pins of the lamps when the lamps are inserted;

a plurality of longitudinal reinforcing ribs on a side wall of each of said tubular compartments;

clamp means detachably connected to said tubes for rigidly clamping said tubes to a support structure and for supporting said tubes in a substantially vertical position;

said detachable connection comprising two L-shaped protrusions connected to said tubes and two L-shaped channels connected to said clamp means, said channels receiving therein said L-shaped protrusions; and a reinforcing rib on said detachable connection between said clamp means and said tubes, said tubes including openings in the bottom ends thereof.

4. In combination:

a first rigid tubular compartment and a second rigid tubular compartment, said tubular compartments having open top ends and closed off bottom ends and having sufficient length and width to support therein upon said closed off bottom ends elongate fluorescent lamps, said tubular compartments being connected together substantially parallel to one another with the bottom ends being vertically offset so that upper ends of lamps of the same length received in the compartments will be vertically offset thereby enabling easy grasping and viewing of the upper ends of the lamps, a resilient cushion within each of said tubular compartments located on the bottom ends thereof adapted for cushioning the ends of lamps supported in the compartments to prevent breakage and damage to the contact pins of the lamps when the lamps are inserted;

clamp means connected to said tubular compartments for rigidly clamping said tubular compartments to a support structure and for supporting said compartments in a substantially vertical position; and a fluorescent lamp vertically received in each of said tubular compartments, lower ends of the fluorescent lamps being supported on respective said resilient cushions.

5. The combination of claim 4 further comprising:

third and fourth tubular compartments connected to said first and second compartments, said third and fourth compartments having open top ends and closed off bottom ends and having sufficient length and width to support therein upon said closed off bottom ends elongate fluorescent lamps, said third and fourth tubular compartments being substantially parallel to said first and second compartments with the bottom ends thereof being vertically offset so that upper ends of lamps of the same length received in the third and fourth compartments will be vertically offset thereby enabling easy grasping and viewing of the upper ends of the lamps;

a resilient cushion within each of the third and fourth compartments located on the bottom ends thereof adapted for cushioning the ends of the lamps supported in the compartments to prevent breakage and damage to the contact pins of the lamps when the lamps are inserted; and a fluorescent lamp vertically received in each of the third and fourth compartments, lower ends of the fluoresecent lamps being supported on respective resilient cushions.

* * * * *

UNITED STATES PATENT AND TRADEMARK OFFICE

CERTIFICATE OF CORRECTION

PATENT NO. : 4,613,042

DATED : September 23, 1986

INVENTOR(S) : Walter H. Aeschliman

It is certified that error appears in the above-identified patent and that said Letters Patent is hereby corrected as shown below:

Claim 3, Col. 7, line 44, insert --top-- before "ends"

Signed and Sealed this

Twenty-seventh Day of January, 1987

*Attest:*

DONALD J. QUIGG

*Attesting Officer* *Commissioner of Patents and Trademarks*